United States Patent [19]

Pullman

[11] Patent Number: 4,739,455

[45] Date of Patent: Apr. 19, 1988

[54] TORCHES

[76] Inventor: Burke C. Pullman, 31, Gledhow Gardens, London SW5, England

[21] Appl. No.: 831,427

[22] Filed: Feb. 20, 1986

[51] Int. Cl.[4] ..... F21L 1/00

[52] U.S. Cl. ..... 362/189; 362/200

[58] Field of Search ..... 362/157, 189, 200, 109, 362/186, 196, 208, 186, 204, 205

[56] References Cited

U.S. PATENT DOCUMENTS

| | | | |
|---|---|---|---|
| 1,996,655 | 4/1935 | Rhein et al. | 362/200 |
| 2,272,040 | 2/1942 | Muldoon | 362/196 |
| 2,483,820 | 10/1949 | Falge | 362/189 |
| 4,122,510 | 10/1978 | Halliday, Jr. | 362/189 |
| 4,237,527 | 12/1980 | Breedlove | 362/189 |

FOREIGN PATENT DOCUMENTS

| | | | |
|---|---|---|---|
| 577906 | 5/1933 | Fed. Rep. of Germany | 362/200 |
| 480193 | 2/1938 | United Kingdom | 362/186 |
| 990669 | 4/1965 | United Kingdom . | |
| 1242396 | 8/1971 | United Kingdom . | |

*Primary Examiner*—William A. Cuchlinski, Jr.
*Assistant Examiner*—D. M. Cox
*Attorney, Agent, or Firm*—Young & Thompson

[57] ABSTRACT

A torch has a tray (1) to receive batteries (14) and a U-shaped cover (2) which snaps into engagement embracing the tray and confining the batteries. A bulb (3) is located by a resilient formation (21) of the tray and projects partially through an aperture (38) in the web of the cover, by which it is retained. A resilient side (9) of the tray is deformable inwardly to close a contact (17) to switch on. The cover is of translucent plastics material, such as acrylic, and an underlay sheet (41) of pictorial or graphic character will be illuminated by light from the bulb diffusing through the cover.

6 Claims, 2 Drawing Sheets

TORCHES

This invention relates to torches.

The general purpose of an electric torch is known well enough. They can be made in a considerable range of sizes and particularly at the smaller end they may be produced on a mass scale very inexpensively.

It is customary for many commercial and business enterprises to use promotions to boost trade, often giving away samples of the goods concerned or articles not directly associated but capable of carrying advertising material that does draw the recipients' attention to those goods. Such articles, if they are to be liberally distributed, necessarily must not be too costly. At the same time they should not be instant 'throwaways' but rather something of utility that merits repeated use or which is likely to be kept handy. A small pocket torch comes into this category.

The advertising material may simply be adhered to the outside, or even moulded into the plastics casing. The former is vulnerable to handling and repeated use; the label can easily become torn, smudged or even dislodged altogether. The latter is too permanent, and is only justifiable if there is an enormous order for a single customer.

It is an aim of this invention to provide a torch which can largely obviate these disadvantages.

A pocket torch requires its batteries to be replaced from time to time, and also its bulb. To gain access to these, the torch has to be dismantled, often by unscrewing two parts or prieing apart two snap-together halves. The screw action is frequently stiff and awkward and a snap-together casing is sometimes impenetrable without breaking the holding lugs, for example. A small screw-in bulb is also an awkward thing to extract, particularly with a tapering smooth glass head as the only grip.

Furthermore, a torch must have a switch to turn it on and off, and the usual arrangement is to have an external button or slider which can be pressed in or moved relative to the casing of the torch. This actuates a contact element within. However, this leads to a multiplicity of parts, some of which are rather vulnerable. A common cause of torch failure is a broken or jammed switch.

Another aim of this invention is therefore to simplify assembly and dis-assembly, to keep the number of parts, particularly moving parts, low and to protect the switch mechanism.

According to one aspect of the present invention there is provided an electric torch with a bulb and having a removable cover of translucent plastics material beneath which pictorial or graphic sheet material can be placed to be illuminated by light diffusing through the cover from the bulb.

The pictorial or graphic material may be advertising, but it could equally well be anything from the useful to the frivolous, such as a timetable, a list of telephone numbers, or a photograph. All these would be replaceable, at the owner's choice.

According to another aspect of the present invention there is provided a torch with a tray adapted to receive a battery or batteries and to locate a bulb, and a cover of generally U-shape which fits over the tray to confine the battery or batteries, the bulb projecting through an aperture in the web of the U.

Although the cover will conveniently snap into engagement, the two limbs of the U closing towards each other when the tray is fully embraced, it will be quite easily released as those limbs are connected only by the web and can be flexed outwardly from that region without undue force.

Conveniently, a side of the tray, exposed within the bight of the U-shaped cover, is deformable to make a contact between the battery or batteries. This side may be resilient and revert to a "switched-off" position when closed.

Preferably the bulb is located by a resilient formation of the tray laterally engaging its base, and is confined by said aperture engaging a shoulder in the head of the bulb. Thus once the cover is removed, the bulb can simply be eased clear of the tray without any unscrewing.

For a better understanding of the invention one embodiment will now be described, by way of example, with reference to the accompanying drawings, in which.

Figure 1:
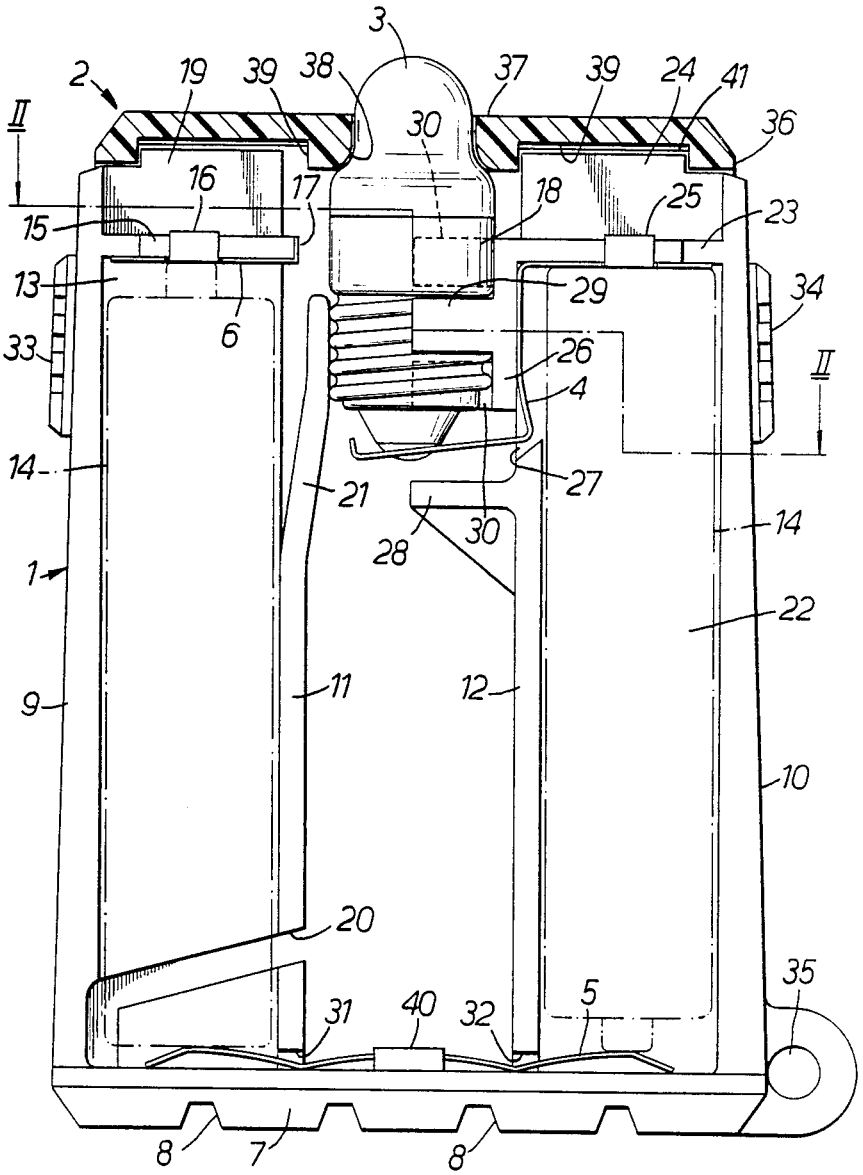
FIG. 1 is a longitudinal section of a torch, on the line I—I of FIG. 3.

The torch has a body made in two parts. A first part 1 is a battery tray and base moulded in resilient plastics material, and the second part 2 is a cover, also of moulded plastics and preferably clear or translucent. The other components of the torch are a bulb 3, and conductive metal contact elements 4, 5 and 6.

The part 1 has a base 7 of generally rectangular form, with transverse grooves 8 in its outer surface which gives it slight flexibility and an ability to bow into shallow, outwardly convex U-shape. Extending up from the base 7 there are two outer side walls 9 and 10 and two inner partition walls 11 and 12. The edges of the walls 9 and 11 remote from the sectional plane I—I are joined over a substantial part of their length by a web 13, which thus forms a box-like compartment for one of the batteries 14, indicated in broken lines. The upper end of this compartment is defined by a transverse wall 15 whose underside is covered by the metal contact element 6. This has tabs 16 at each side which are bent up and back over the edges of the wall 15 to secure the element, and at its inner end there is an upturned flange 17, backed by the inner edge of the wall 15, which will be directly opposite, and closely spaced from, the cylindrical metal part 18 of the bulb between the glass and the thread. The wall 15 is reinforced by a central web 19 which extends inwardly from the upper end of the wall 9 beyond the battery compartment.

The web 13 and wall 11 are not continuous. Towards the lower end, they are interrupted by an angled slot 20 which extends to the side wall 9, and then turns down to end at the base 7. The side wall 9 is locally of reduced thickness at this zone. Also, somewhat more than half way up the web 13, the wall 11 slants away from it and then straightens again to form a cranked finger 21 with an ability to flex. In its relaxed position it will be slightly more cranked than shown in FIG. 1, but when the bulb is inserted it is stressed and acts as a keeper for the bulb, bearing on its threaded portion.

Figure 2:
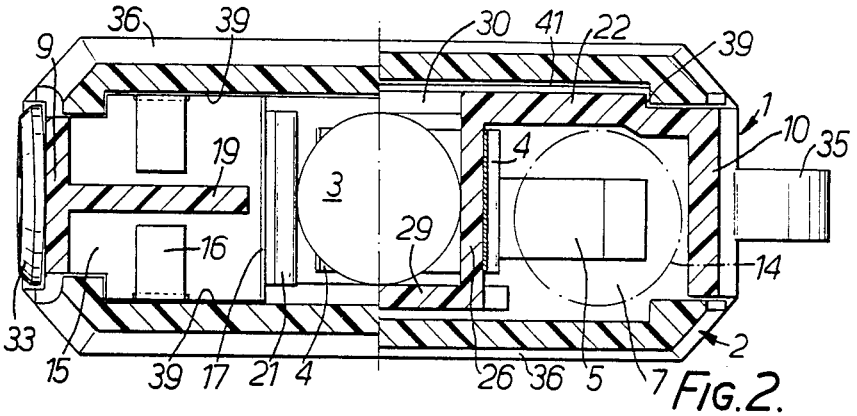
FIG. 2 is a cross section on the line II—II of FIG. 1.
Figure 3:
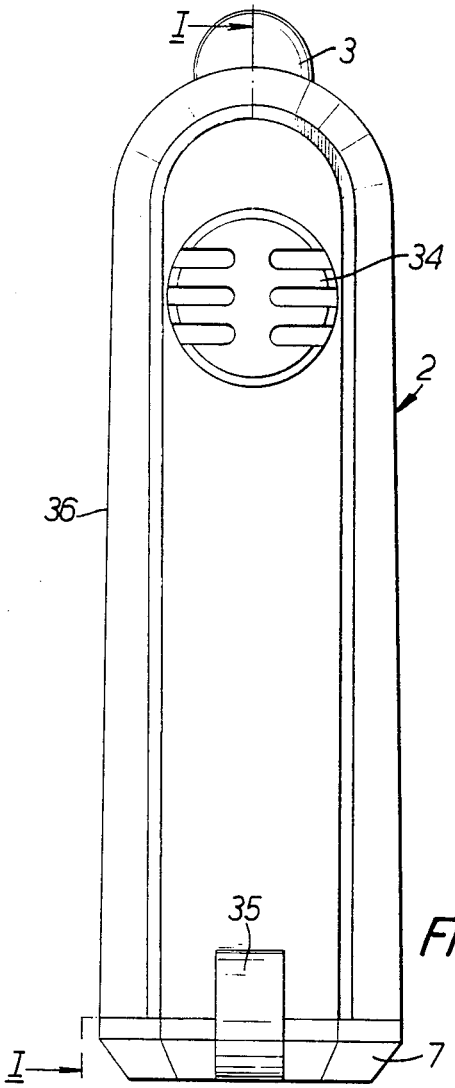
FIG. 3 is a side elevation of the torch.

The other side of the torch is somewhat different, but in similar fashion the far edges of the walls 10 and 12 as seen in FIG. 1 are joined by a web 22 and an end wall 23 to form a battery compartment, and the wall 23 is backed by a central reinforcing web 24. There is no slot corresponding to 20. The contact element 4 is of generally Z-form, and one flange is secured to the underside of the wall 23 by bent over tabs 25, similar to those of the contact member 6. The central portion of the element 4 extends down the battery side of a flange 26 upstanding from the edge of the web 22 and slightly offset towards the longitudinal centre line of the torch in relation to the wall 12. There is a gap 27 between this flange 26 and the upper end of the wall 12, and the element 4 turns through it for its other flange to be contacted by the base of the bulb 3. The wall 12 has an abutment 28 near its upper end projecting towards the centre line, which serves as a backstop for this contact flange of the element 4. An arm 29 projects towards the centre of the torch from the end of the flange 26 remote from the web 22 and two arms 30 above and below the arm 29 in relation to the base 7 form continuations of the web 22 towards the torch centre. There is thus a U-shaped formation as viewed in FIG. 2 for receiving the base of the bulb 3. It is kept there by the resilient finger 21 of the wall 11.

The batteries 14 are connected in series between the contact elements 3 and 4 via the element 5 which is of shallow W-shape and captive in slots 31 and 32 at the bases of the walls 11 and 12.

Externally, the side walls 9 and 10 have integrally moulded button formations 33 and 34 opposite the upper ends of the battery compartments. At the junction of the wall 10 and the base 7 there is an eye 35, by which to attach the torch to a lanyard, for example.

The second part 2 is of generally U-form having flat sides 36 and a curved web 37. This has a central aperture 38 internally contoured to match the shoulder in the glass portion of the bulb 3, whose tip projects above the web 37. The flat sides 36 cover the top and bottom of the battery tray, assuming now it is laid flat. The part 2 is a press fit on the part 1, being located by various co-operating formations. For example, in FIG. 1 the web 24 has a stepped upper edge which fits lengthwise exactly within a recess 39 in the inside of the web 36. This recess in fact extends over almost the entire inner surface of the part 2 as further references 39 indicate. It has two large rectangular portions within the two sides 36 joined by two semi-cylindrical portions, one each side of the bulb 3. Adjacent the base 7, the edges of the sides 36 have inwardly projecting ribs 40 which snap into the mouths of slots 31 and 32 on one side or into detents (not shown) on the other side of the walls 11 and 12.

To operate the torch, the button formations 33 and 34 are squeezed towards each other. It will be seen in FIG. 1 that the web 19 has freedom to move from left to right, although entered in the part of the recess 39 in the underside of the web 37. The reduced thickness of the lower end of the wall 9 will act as a hinge and the base 7 may also flex. The contact element 6 is therefore moved towards the bulb 3, and the associated battery compartment moves bodily with it. The finger 21 straightens but does not prevent this movement. The flange 17 contacts the portion 18 and the bulb is lit. Release cf pressure on the button formation 33 allows the natural resilience of the plastics to restore the torch to its original shape and thus switch off.

As well as providing the usual torch light, some of the light from the bulb 3 will be diffused through the translucent plastics material of the part 2, particularly if that material is acrylic. This will illuminate advertising or other material on a sheet 41 located within the recess 39 and visible to the exterior.

It is now possible to produce sheet material at reasonable cost which can produce holographic images when suitably illuminated, and the sheet 41 may be of this kind.

Another use of the light transmission properties of acrylic is to recess a mirror, preferably with bevelled edges, into one of the sides 36. This will help illuminate the subject using the mirror; for example, it would be an aid to checking or applying cosmetics.

There could be provided an internal catch mechanism (for example the web 19 might engage an integrally formed clip on the inside of the web 37) to hold the torch on. It would be released by locally squeezing the sides 36, which will have assumed a slight outward bulge. Alternatively, the button formation 33 could be replaced by a movable button or slider which could be used to move a catch into the recess 39 and thus hold the torch on.

I claim:

1. An electric torch comprising a unitary body of tray-like form to receive battery means and to locate a bulb, a removable cover of translucent plastics material and of generally U-shape which fits over the tray and confines the battery means, the web of the U-shaped cover having an aperture in which at least part of the luminous portion of a bulb is disposed when properly mounted to the body, and a display zone defined by at least one leg of the U-shaped cover, the display zone being out of direct line of illumination by the bulb, but being illuminated by diffusion of light through the plastics material when the bulb is energised.

2. A torch according to claim 1, in which the cover has a snap engagement with the tray.

3. A torch according to claim 1, in which a side of the tray, exposed within the bight of the U-shaped cover, is deformable to make a contact between the bulb and the battery or batteries.

4. A torch according to claim 3, in which said side is resilient and reverts to a "switched-off" position when released.

5. A torch according to claim 1, in which the bulb has a shouldered head, a resilient formation of the tray laterally engages the base of the bulb, and the bulb is confined by said aperture engaging said shoulder.

6. A torch according to claim 1, wherein the display zone includes a mirror.

* * * * *